US009561921B2

(12) United States Patent
Takai

(10) Patent No.: US 9,561,921 B2
(45) Date of Patent: Feb. 7, 2017

(54) SHEET FEEDING UNIT AND IMAGE FORMING APPARATUS

(71) Applicant: KYOCERA Document Solutions Inc., Osaka (JP)

(72) Inventor: Hiroaki Takai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/074,146

(22) Filed: Mar. 18, 2016

(65) Prior Publication Data

US 2016/0280481 A1 Sep. 29, 2016

(30) Foreign Application Priority Data

Mar. 26, 2015 (JP) ..... 2015-063576

(51) Int. Cl.
*B65H 1/00* (2006.01)
*B65H 1/26* (2006.01)
*B65H 1/04* (2006.01)

(52) U.S. Cl.
CPC ..... *B65H 1/266* (2013.01); *B65H 1/04* (2013.01); *B65H 2511/18* (2013.01)

(58) Field of Classification Search
CPC ..... B65H 1/00; B65H 1/04; B65H 31/20; B65H 2403/41; B65H 2403/411; B65H 2405/00; B65H 2405/1116; B65H 2405/114; B65H 2511/10; B65H 2511/12; B65H 2511/18
USPC ..... 271/171
See application file for complete search history.

(56) References Cited

U.S. PATENT DOCUMENTS 6,070,048 A * 5/2000 Nonaka ..... B65H 1/00 399/376
7,770,886 B2 * 8/2010 Yoshiuchi ..... B65H 31/38 271/171
7,845,632 B2 * 12/2010 Windsor ..... B65H 1/04 271/171
8,210,525 B2 * 7/2012 Ushiyama ..... B65H 1/266 271/171

FOREIGN PATENT DOCUMENTS

JP 2009-184789 A 8/2009

* cited by examiner

*Primary Examiner* — David H Bollinger
(74) *Attorney, Agent, or Firm* — Studebaker & Brackett PC

(57) ABSTRACT

An attachably/detachably sheet feeding unit includes a main body part, a pair of side cursors, a pair of cursor racks, a pinion and a holding member. On the main body part having a bottom plate, a sheet is placed. The side cursors are supported by the bottom plate to slide in a width direction of the sheet to restrict a position of the sheet in the width direction. The cursor racks respectively extend from the side cursors in opposing directions in the width direction. The pinion is engaged with the cursor racks. The holding member has a shaft support part rotatably supporting the pinion, is attachable/detachable to/from the bottom plate, and then, is supported to the bottom plate to move in the width direction while the pinion is engaged with the cursor racks, and is fixed to the bottom plate in an optional position in the width direction.

8 Claims, 10 Drawing Sheets

SHEET FEEDING UNIT AND IMAGE FORMING APPARATUS

INCORPORATION BY REFERENCE

This application is based on and claims the benefit of priority from Japanese Patent application No. 2015-063576 filed on Mar. 26, 2015, the entire contents of which are incorporated herein by reference.

BACKGROUND

The present disclosure relates to a sheet feeding unit for storing sheets fed to an image forming apparatus or the like and an image forming apparatus including the sheet feeding unit.

In an image forming apparatus, such as a multifunction peripheral and a printer, sheets are fed from a sheet feeding unit, such as an attachably/detachably supported sheet feeding cartridge and a manual feeding tray, to an image forming part. In the sheet feeding cartridge, a pair of cursors slidably provided restrict a position of a sheet in a width direction. A mechanism for sliding the pair of cursors is generally configured to synchronously slide the pair of cursors in approaching and separating directions in the width direction of the sheets by a rack and pinion mechanism including racks respectively provided in the pair of cursors and a pinion engaged with the pair of racks.

In the sheet feeding cartridge including such a slide mechanism, it is necessary to coincide a center position of the sheet restricted by the pair of cursors (a center position between the pair of cursors) with a center position of an image formed in the image forming part. When the center position of the sheet is not coincided with the center position of the image in the width direction of the sheet, for example, in a case where a post-treatment such as opening a punch hole is performed, the punch hole interferes with the image, or in a case where multi-staged cartridges are used, the position of the punch hole is displaced in every sheet fed from each cartridge.

In order to position the center of the pair of cursors in the width direction, there is an image forming apparatus including a sheet feeding cartridge configured to support the pair of cursors and a slide mechanism and to move a support member together with the pair of cursors in the width direction.

However, in the sheet feeding cartridge as mentioned above, there is a problem that a size of the support member is enlarged and does not match a sheet feeding cartridge having a low height in recent years. In addition, there is a problem that points where the support member is fixed to the sheet feeding cartridge are increased, thereby deteriorating in workability.

On the other hand, in a sheet feeding cartridge including the pair of cursors, there is also a problem that in a case where a user inserts the sheet feeding cartridge by strong force when the user installs the sheet feeding cartridge, the force is applied from the sheets stored in the sheet feeding cartridge to the cursor and the slide mechanism, thereby resulting in displacement of the center position of the pair of cursors in the width direction.

SUMMARY

In accordance with the present disclosure, a sheet feeding unit is attachable to and detachable from an apparatus main body and includes a main body part, a pair of side cursors, a pair of cursor racks, a pinion and a holding member. The main body part has a bottom plate and is configured to be arranged on which a sheet is placed. The pair of side cursors are supported by the bottom plate so as to slide in a width direction of the sheet to restrict a position of the sheet in the width direction. The pair of cursor racks respectively extend from the pair of side cursors in directions opposing to each other in the width direction of the sheet. The pinion is engaged with the pair of cursor racks. The holding member has a shaft support part rotatably supporting the pinion. Further, the holding member is attachable to and detachable from the bottom plate. The holding member is configured to be supported so as to move in the width direction of the sheet with respect to the bottom plate in a state that the engagement of the pinion with the pair of cursor racks is maintained, and to be fixed to the bottom plate in any optional position in the width direction of the sheet.

An image forming apparatus of the present disclosure includes the sheet feeding unit.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, an image forming apparatus according to an embodiment of the present disclosure will be described.

Figure 1:
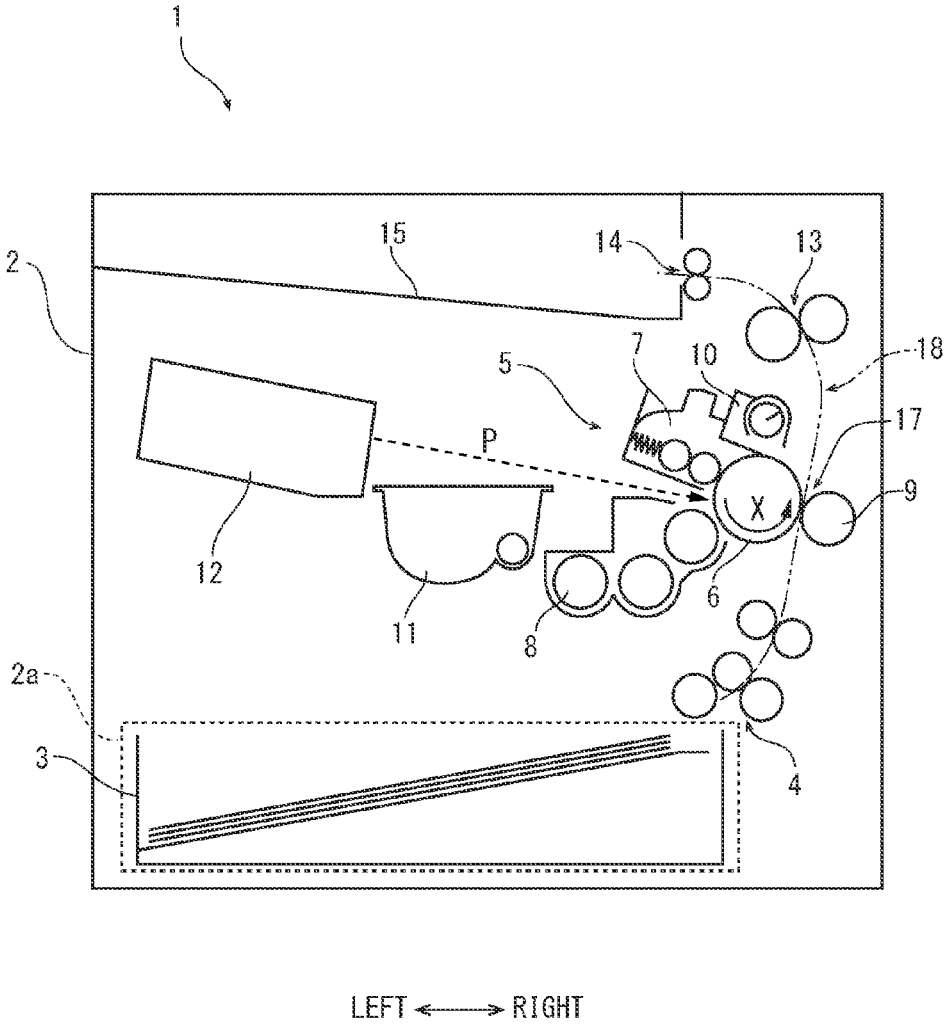
FIG. 1 is a sectional view schematically showing an internal structure of a printer according to an embodiment of the present disclosure.

First, with reference to FIG. 1, the entire configuration of a printer 1 as an image forming apparatus will be described. FIG. 1 is a schematic diagram schematically showing the printer according to the embodiment of the present disclosure. Hereinafter, it will be described so that the front side of the printer 1 is positioned at the front side of FIG. 1, and left and right directions are defined with reference to a direction when seeing the printer 1 from the front side.

The printer 1 includes a roughly rectangular parallelepiped housing 2 (an apparatus main body) having a hollow part. In a lower part of a front face of the housing 2, an opening part 2*a* is formed. Into the opening part 2*a*, a sheet feeding cartridge 3 (a sheet feeding unit) storing sheets is attachably/detachably installed in forward and backward directions. At a right upper side of the sheet feeding cartridge 3, a sheet feeding device 4 feeding sheets from the sheet feeding cartridge 3 is provided.

Above the sheet feeding device 4, an image forming part 5 is provided. In the image forming part 5, a photosensitive drum 6 is rotatably provided. Around the photosensitive drum 6, a charging device 7, a development device 8, a transferring roller 9 and a cleaning device 10 are located along a rotation direction of the photosensitive drum 6 (refer to an arrow X in FIG. 1). The development device 8 is connected to a toner container 11. In addition, at a left side of the image forming part 5, an exposure device 12 composed of a laser scanning unit (LSU) is provided.

Above the image forming part 5, a fixing device 13 is provided. At the left side of the fixing device 13, a sheet ejecting part 14 is provided. The sheet ejecting part 14 faces to an ejected sheet tray 15 formed on an upper surface of the housing 2.

In addition, inside the housing 2, a sheet conveyance path 18 is provided so as to travel from the sheet feeding device 4, to pass through a transferring nip formed between the photosensitive drum 6 and the transferring roller 9 and the fixing device 13 and to go toward the sheet ejecting part 14.

Next, the operation of forming an image by the printer 1 having such a configuration will be described. After a surface of the photosensitive drum 6 is electrically charged by the charging device 7, exposure corresponding to image data is carried out to the photosensitive drum 6 by a laser light (refer to an arrow P) from the exposure device 12. Thereby, an electrostatic latent image is formed on the surface of the photosensitive drum 6. The electrostatic latent image is developed to a toner image by the development device 8. Toner remained on the photosensitive drum 6 is removed by the cleaning device 10.

On the other hand, the sheet fed from the sheet feeding cartridge 3 to the conveyance path 18 by the sheet feeding device 4 is conveyed to the transferring nip 17 in a suitable timing for the above-mentioned image forming operation. Then, in the transferring nip 17, the toner image on the photosensitive drum 6 is transferred onto the sheet. The sheet with the transferred toner image is conveyed to a downstream side on the conveying path 18 to enter the fixing device 13, and then, the toner image is fixed on the sheet in the fixing device 13. The sheet with the fixed toner image is ejected from the sheet ejecting part 14 onto the ejected sheet tray 15.

Figure 2:
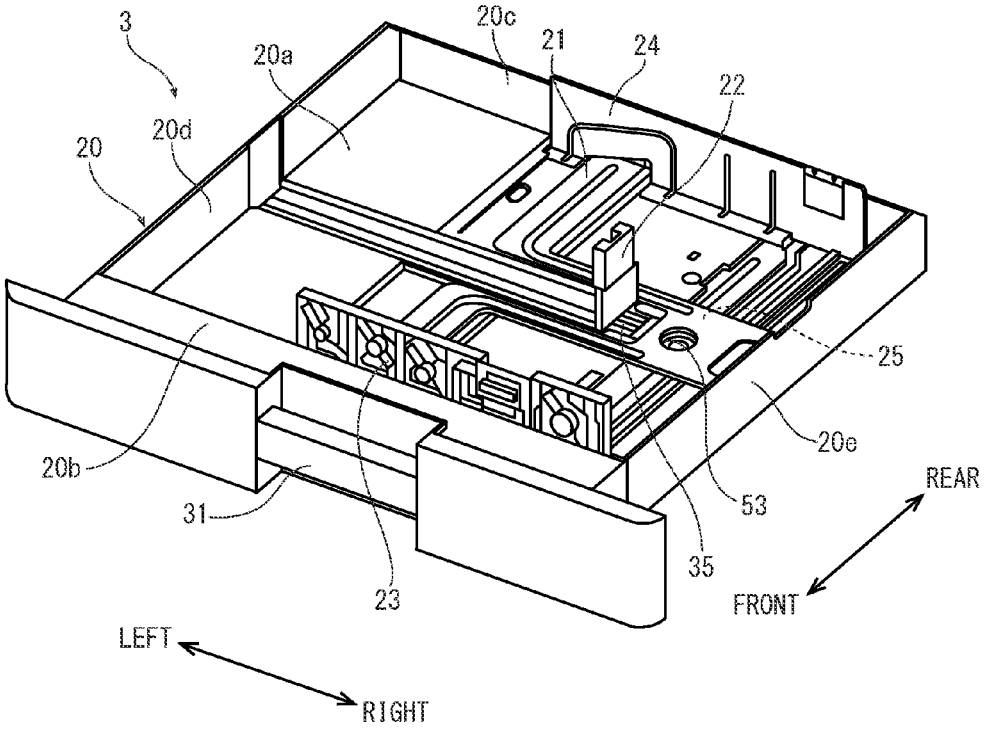
FIG. 2 is a perspective view showing a sheet feeding cartridge according to the embodiment of the present disclosure.
Figure 3:
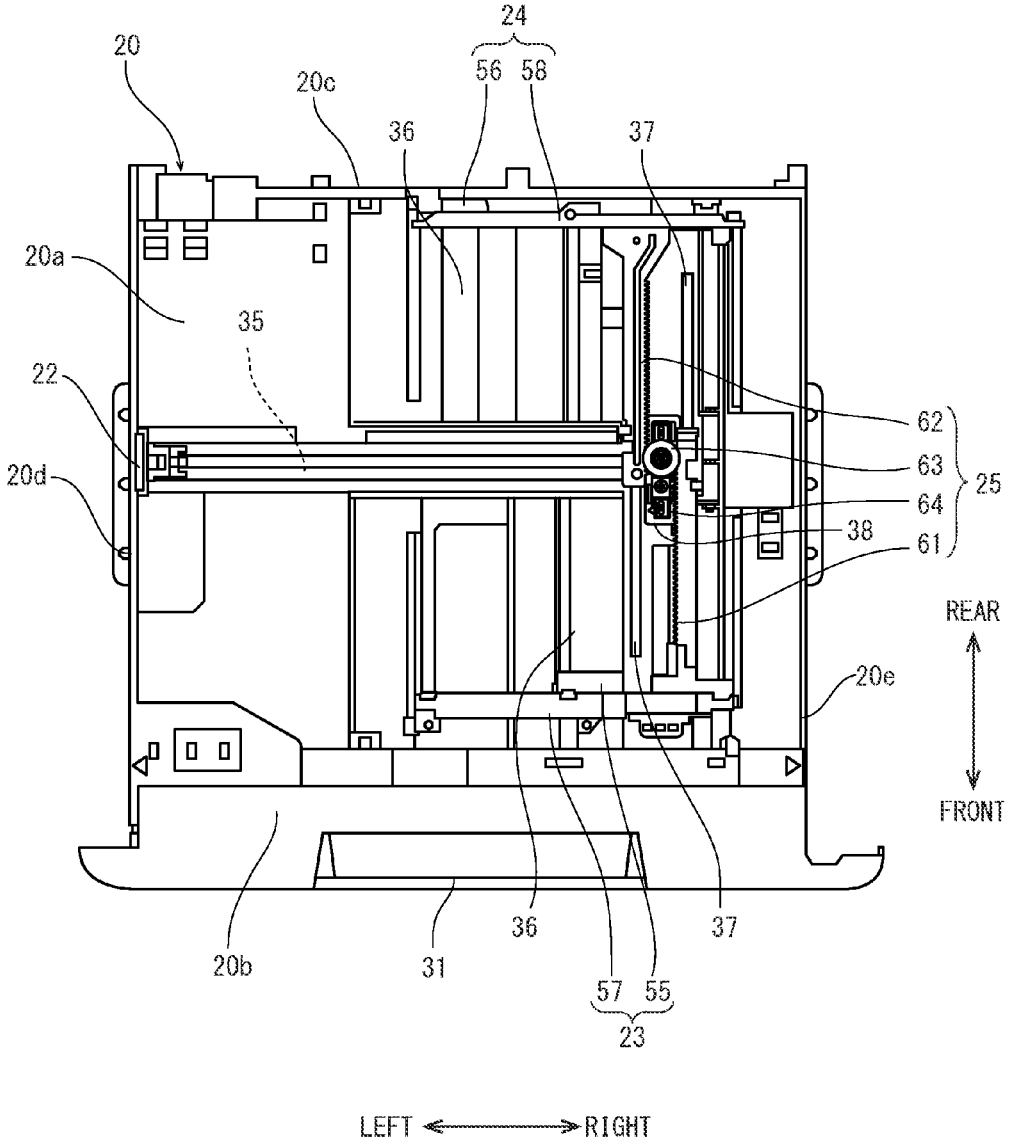
FIG. 3 is a plan view showing a main body part of the sheet feeding cartridge according to the embodiment of the present disclosure.
Figure 4:
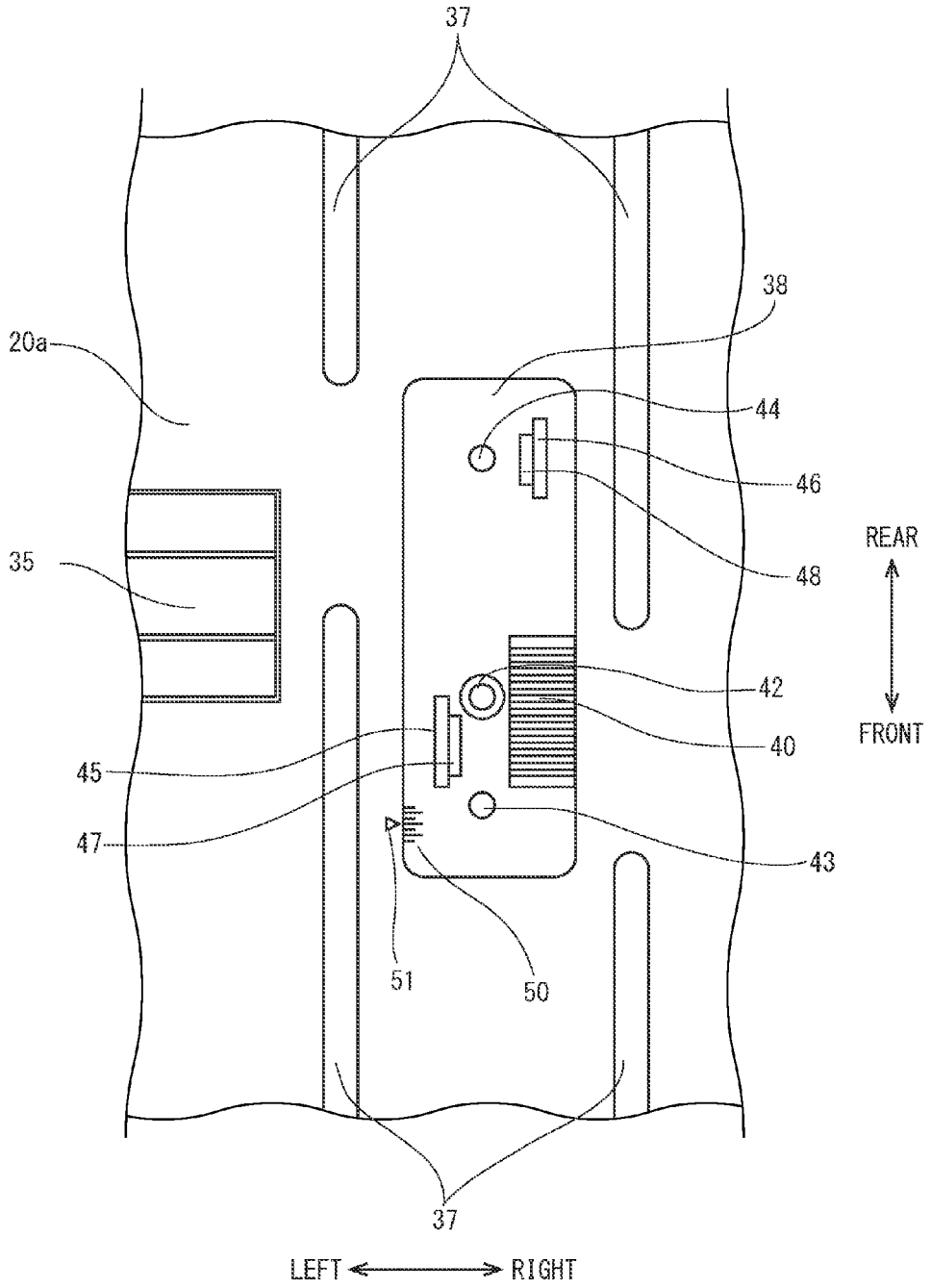
FIG. 4 is a plan view showing a depression formed in a bottom plate of the sheet feeding cartridge according to the embodiment of the present disclosure.
Figure 5A:
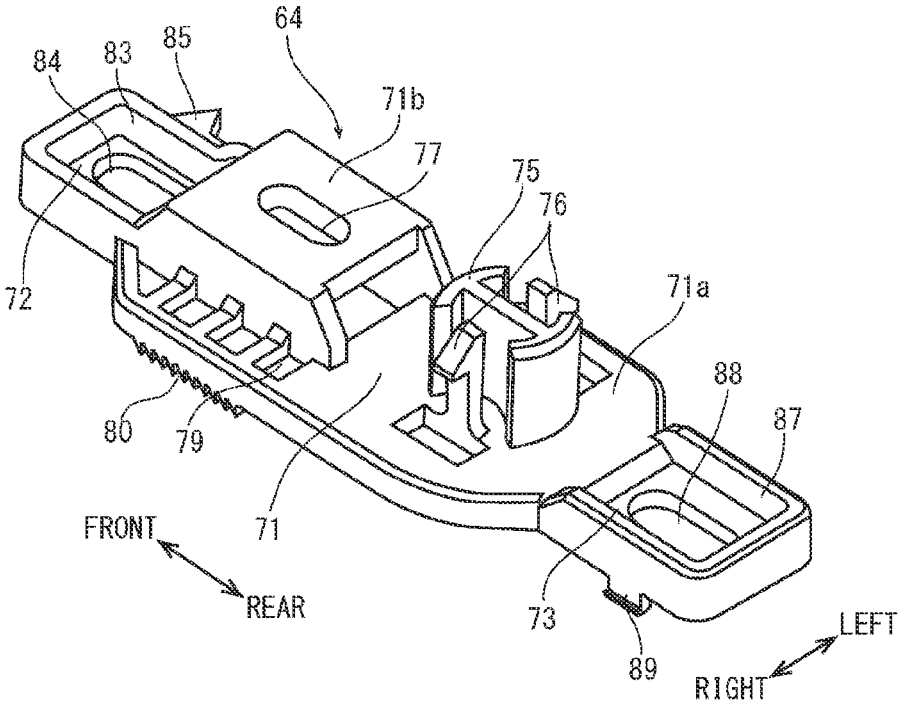
FIG. 5A is a perspective view showing a holding member seen from an upper side in the sheet feeding cartridge according to the embodiment of the present disclosure.
Figure 5B:
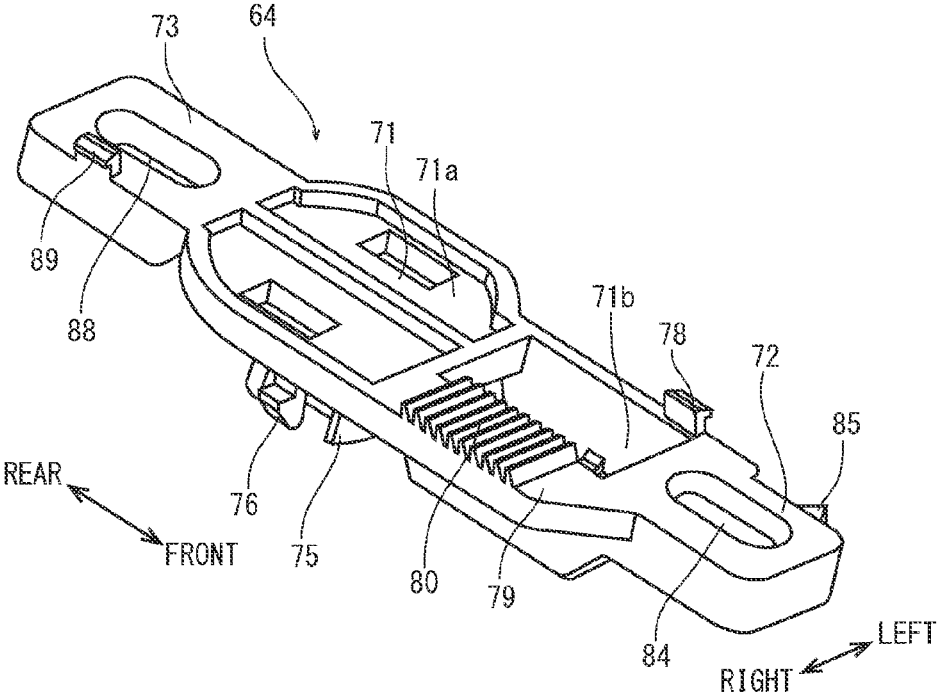
FIG. 5B is a perspective view showing the holding member seen from a lower side in the sheet feeding cartridge according to the embodiment of the present disclosure.
Figure 6:
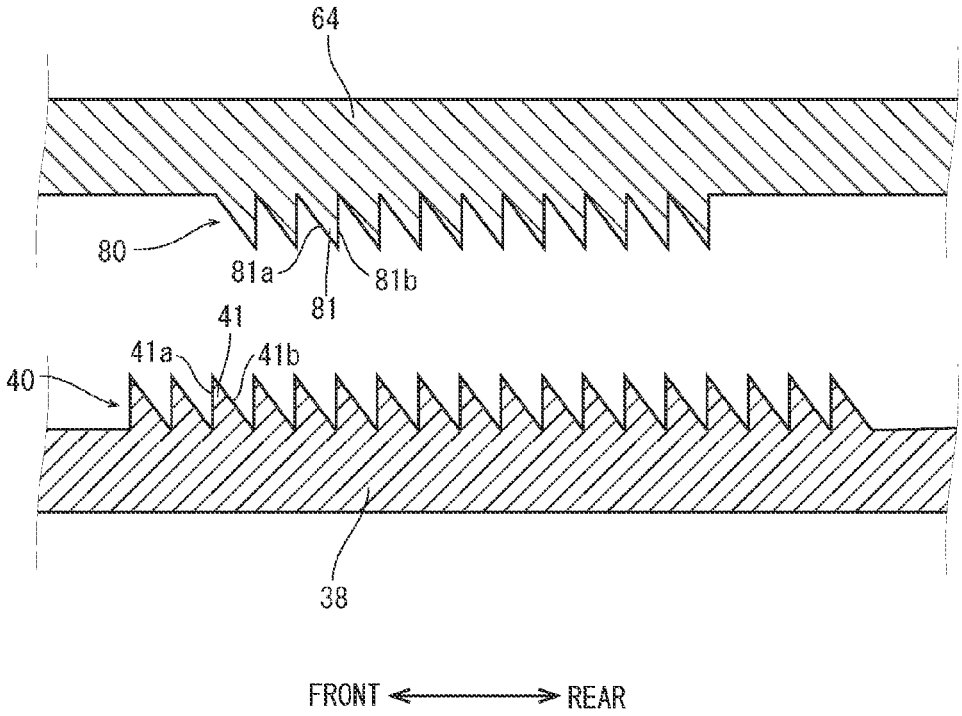
FIG. 6 is a side sectional view showing a first rack part and a second rack part in the sheet feeding cartridge according to the embodiment of the present disclosure.

Next, with reference to FIG. 2 to FIG. 6, the sheet feeding cartridge will be described. FIG. 2 is a perspective view of the sheet feeding cartridge, FIG. 3 is a plan view of a main body part of the sheet feeding cartridge, FIG. 4 is a plan view showing a part of a bottom plate of the main body part, FIG. 5A and FIG. 5B are perspective views showing a holding member, FIG. 6 is a side sectional view showing a first rack part and a second rack part. In the following description, left and right directions designate a conveyance direction of the sheet, and the forward and backward directions designate a width direction of the sheet.

The sheet feeding cartridge 3, as shown in FIG. 2, includes a main body part 20 in which the sheet is stored, an elevating plate 21 on which the sheet is stacked in the main body part 20, an end cursor 22 slidably supported in the conveyance direction of the sheet, a front cursor 23 and a rear cursor 24 (a pair of side cursors) slidably supported in the width direction of the sheet and a slide mechanism 25 provided between the front cursor 23 and the rear cursor 24 to slide both the cursors.

The main body part 20 has a shallow box-like shape of which an upper face is opened. The main body part 20 includes a bottom plate 20*a*, front and rear side plates 20*b* and 20*c*, and left and right side plates 20*d* and 20*e*. In the front side plate 20*b*, a grip 31 for pulling out the sheet feeding cartridge is provided.

In the bottom plate 20*a*, as shown in FIG. 3, at a center in the forward and backward directions, a central groove 35 shallowly extending in the left and right directions is formed. In addition, in the bottom plate 20*a*, at both front and rear sides positioned across a central groove 35, respective guiding depressions 36 extending in the forward and backward directions, and a pair of respective guiding grooves 37 extending parallel to each other in the forward and backward directions are formed. The guiding depressions 36 are formed in the vicinity of the center in the left and right directions, and the pair of guiding grooves 37 are formed at a right side from the guiding depressions 36. Between the pair of front and rear guiding grooves 37, a rectangular depression 38 elongated in the forward and backward directions is formed.

With reference to FIG. 4, the depression 38 will be described. In the depression 38 on an upper face of the bottom plate 20*a*, a first rack part 40 is formed along a right edge in a position at a front side from the center in the forward and backward directions. As shown in FIG. 6, in the first rack part 40, teeth 41 extending in the left and right directions are formed at predetermined pitches along the forward and backward directions. Each of the teeth 41 is formed so as to have a cross section of a right triangle shape and to have a front side face 41*a* as a perpendicular face and a rear side face 41*b* as an inclined face.

Further, in the depression 38, as shown in FIG. 4, at a left side of the first rack part 40, a boss 42 in which a screw hole is formed is vertically arranged. In addition, at front and rear sides of the boss 42 (at both sides of the boss 42 in the width direction), front and rear guiding protrusions 43 and 44 are vertically arranged, respectively. Moreover, at a left side of the boss 42 and the front guiding protrusion 43 and at a right side of the rear guiding protrusion 44, front and rear guiding projection parts 45 and 46 extending in the forward and backward directions are formed, respectively. Furthermore, along a right edge of the front guiding projection part 45 and a left edge of the rear guiding projection part 46, front and rear groove parts 47 and 48 extending in the forward and backward directions are formed, respectively.

In addition, on the bottom face of the depression 38, a scale 50 marked every 1 mm along the front part of the left edge in the forward and backward directions is formed. The scale 50 is formed within the scope of 6 mm, and a mark 51 pointing a reference position is denoted in the center of the scale 50.

As shown in FIG. 2, the elevating plate 21 is placed above the front cursor 23, the rear cursor 24 and the slide mechanism 25 on the bottom plate 20*a* of the main body part 20, and is supported so as to be inclined upwardly around a left end as a fulcrum by an elevating mechanism (not shown). In the elevating plate 21, in the right end part at the center in the forward and backward directions, an opening 53 is formed.

The end cursor 22 is slidably supported along the central groove 35 formed in the bottom plate 20*a* of the main body part 20 in a posture erected with respect to the bottom plate 20*a*.

The front cursor 23 and the rear cursor 24 include respective engaging portions 55 and 56 engaged with the guiding depressions 36 of the bottom plate 20*a* of the main body part 20 and respective side wall parts 57 and 58 roughly erected with respect to the bottom plate 20*a* and extending in the left and right directions. The engaging portions 55 and 56 are guided along the guiding depressions 36, and then, the side wall parts 57 and 58 come into contact with both side edges of the sheet in the width direction.

The slide mechanism 25 includes a pair of cursor racks 61 and 62 respectively provided in the front cursor 23 and the rear cursor 24, a pinion 63 engaged with the pair of cursor racks 61 and 62, and a holding member 64 supporting the pinion 63.

The cursor racks 61 and 62 are extended in directions opposing to each other from in a position displaced in the left and right direction of the front cursor 23 and the rear cursor 24 and, on respective opposing faces of the cursor racks 61 and 62 in the left and right directions, rack teeth are formed. Each of the cursor racks 61 and 62 are engaged with one of parallel guiding grooves 37 formed in the bottom plate 20*a* of the main body part 20, and guided along the guiding grooves 37 in the forward and backward directions. The pinion 63 has a pinion gear meshing with the rack teeth of the cursor racks 61 and 62. The pinion gear is formed so as to have a width broader than the rack teeth of the cursor racks 61 and 62.

The holding member 64 will be described with reference to FIG. 5. FIG. 5A is a perspective view of the holding member seen from an upper side, and FIG. 5B is a perspective view of the holding member seen from a lower side. FIG. 5A differs in the left and right directions from FIG. 5B, that is, the left and right directions are reverse. The holding member 64 is a rectangular plate-like member elongated in the forward and backward directions, and has a front end part 72 and a rear end part 73, and a center part 71 between the front end part 72 and the rear end part 73.

A center rear part 71*a* at a rear side in the center part 71 is formed so that a left end of a roughly circular shape in a planar view is cut out along a chord extending in the forward and backward directions. At the center of the center rear part 71*a*, a boss-like shaft support part 75 having a roughly H-shape seen from a lateral section is vertically arranged. Further, on diagonal locations across the shaft support part 75, a pair of claw parts 76 are vertically arranged so as to elastically deform in a diameter direction of the shaft support part 75.

A center front part 71*b* at a front side in the center part 71 has a hollow truncated square pyramid shape of which front and rear end faces and a lower surface are opened. At the center of the center front part 71*b*, a long hole 77 elongated in the forward and backward directions is formed. The long hole 77 is formed on the same coordinate in the left and right directions as the center of the shaft support part 75. In addition, in the center front part 71*b*, a claw part 78 extending downwardly from a part of a left edge is formed. Further, in the center front part 71*b*, an extending part 79 extending from a right edge toward a right side is formed so as to continue from the center rear part 71*a*.

In a lower face of the extending part 79, a second rack part 80 engaging with the first rack part 40 formed in the depression 38 of the main body part 20 is formed. As shown in FIG. 6, in the second rack part 80, teeth 81 meshing with the teeth 41 formed in the first rack part 40 are formed along the forward and backward directions at predetermined pitches. That is, each of the teeth 81 is formed so as to have a front side face 81*a* as an inclined face and a rear side face 81*b* as a perpendicular face.

The front end part 72 is configured so that an upper face is surrounded a rib 83 along an outer circumference edge and a front slit 84 elongated in the forward and backward directions is formed at the center. The front slit 84 is formed on the same coordinate in the left and right directions as the long hole 77. Further, in the front end part 72, a point protrusion 85 (a point part) having a triangle shape in a planar view and protruding from a left edge is formed.

The rear edge part 73 is configured so that an upper face is surrounded by a rib 87 along the outer circumference edge and a rear slit 88 elongated in the forward and backward directions is formed at the center. The rear slit 88 is formed on the same coordinate in the left and right directions as the long hole 77. In other words, the front slit 84 and the rear slit 88 are arranged at both sides of the long hole 77 in the width direction. Further, in the rear edge part 73, a claw part 89 extending downwardly from a right edge of is formed.

In the holding member 64 having the configuration as described above, the pinion 63 is rotatably supported by being inserted into the shaft support part 75 vertically arranged in the center rear part 71*a* and being retained by the pair of claw parts 76.

Figure 7:
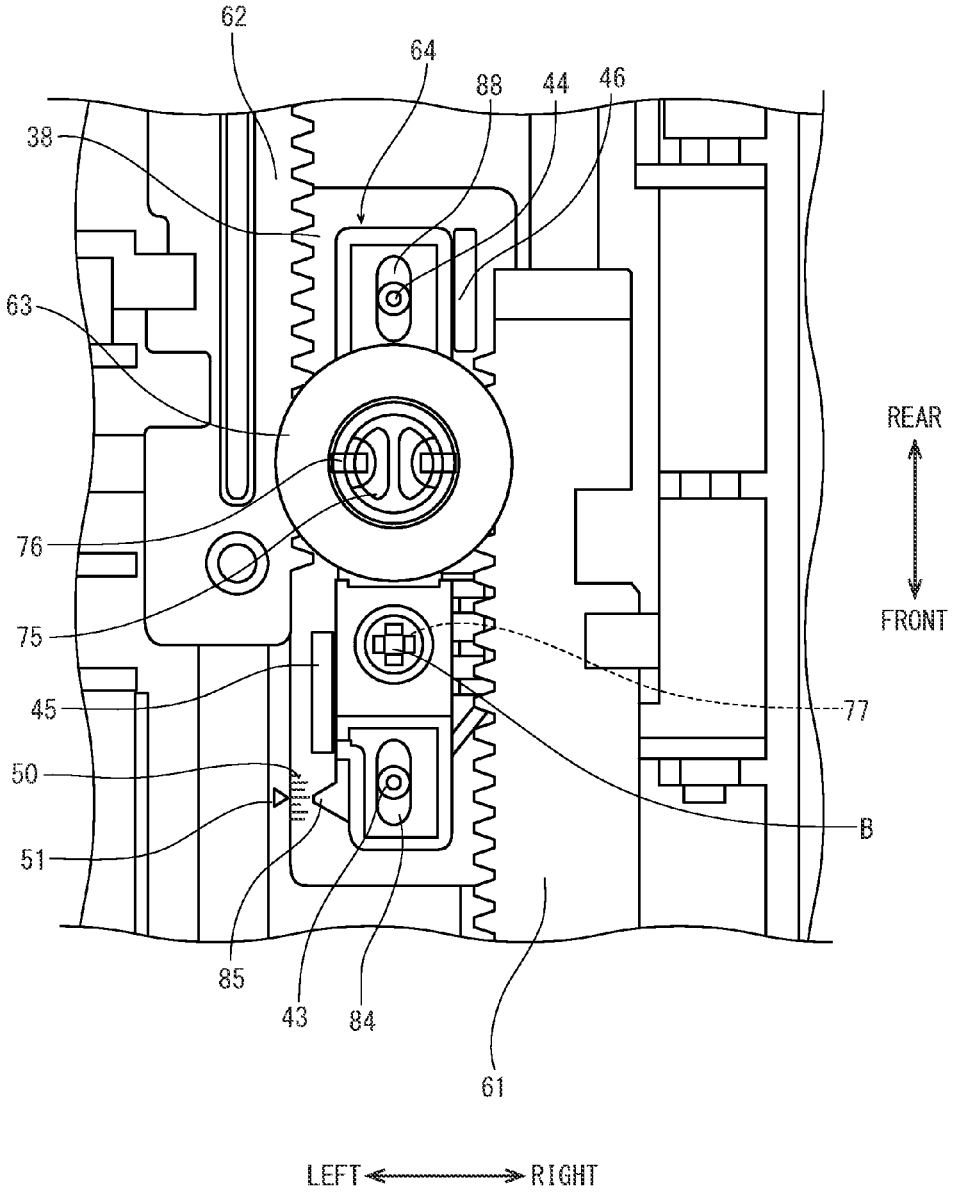
FIG. 7 is a plan view showing the holding member installed on the main body part in the sheet feeding cartridge according to the embodiment of the present disclosure.

With reference to FIG. 7, a procedure for assembling the front cursor 23 and the rear cursor 24 with the main body part 20 will be described. FIG. 7 is a plan view showing a holding member installed onto the depression of the main body part.

In order to assemble the front cursor 23 and the rear cursor 24, firstly, the holding member 64 is positioned so that the point protrusion 85 formed in the front end part 72 points out the mark 51 pointing out the reference position of the scale 50 within the depression 38 formed on the bottom plate 20*a* of the main body part 20. Subsequently, each of the teeth 81 of the second rack part 80 is meshed with each of the teeth 41 of the first rack part 40, and the boss 42 is allowed to enter into the hollow truncated square pyramid shaped center front part 71*b*. Thereby, the front and rear guiding protrusions 43 and 44 of the depression 38 are inserted into the front and rear slits 84 and 88 formed in the front end part 72 and the rear end part 73 of the holding member 64. In addition, the holding member 64 is slidably supported in the width direction of the sheet. Further, the respective claw parts 78 and 89 of the holding member 64 are engaged with the respective groove parts 47 and 48 of the depression 38, the front end part 72 of the holding member and the left edge of the center front part 71*b* are arranged along the guiding projection part 45, and the right edge of rear end part 73 of the holding member 64 is arranged along the guiding projection part 46. In addition, the holding member 64 is attachably/detachably fixed to the depression 38 by inserting the screw B from the long hole 77 of the holding member 64 and fastening the screw B to the boss 42 vertically arranged in the depression 38 in a state that the holding member 64 is slid to any optional position to be positioned.

Next, the front cursor 23 and the rear cursor 24 are set to a predetermined position on the bottom plate 20*a* of the main body part 20, the engaging portions 55, 56 are engaged with the guiding depression 36, respectively, and the cursor racks 61, 62 are engaged with the respective guiding grooves 37. Finally, the pinion 63 is meshed with the cursor racks 61, 62 while the pinion 63 is installed on the shaft support part 75 the holding member 64. The pinion 63 is retained by the claw part 76 in a state that the pinion 63 is meshed with the cursor racks 61, 62. It is to be noted that the holding member 64 may be fixed to the depression 38 after the cursor racks 61, 62 are set to a predetermined position of the bottom plate 20*a*.

After the front cursor 23 and the rear cursor 24 are assembled with the main body part 20 in such a manner, the elevating plate 21 and the end cursor 22 are assembled with the main body part 20. When the elevating plate 21 has an uninclined posture, the pinion 63 and the screw B supported by the holding member 64 are exposed from an opening 53 (refer to FIG. 2) formed in the right end part at the center of the vertically movable plate 21 in the forward and backward directions.

In this state, when one of the front cursor 23 and the rear cursor 24 are slid toward one direction along the guiding depression 36 by a predetermined distance, another of the front cursor 23 and the rear cursor 24 are slid toward another direction along the guiding depression 36 by the same distance as the predetermined distance to come into contact with both side edges in the forward and backward directions of the sheets mounted on the vertically movable plate 21 and to restrict the position of the sheet in the forward and backward directions.

Figure 8:
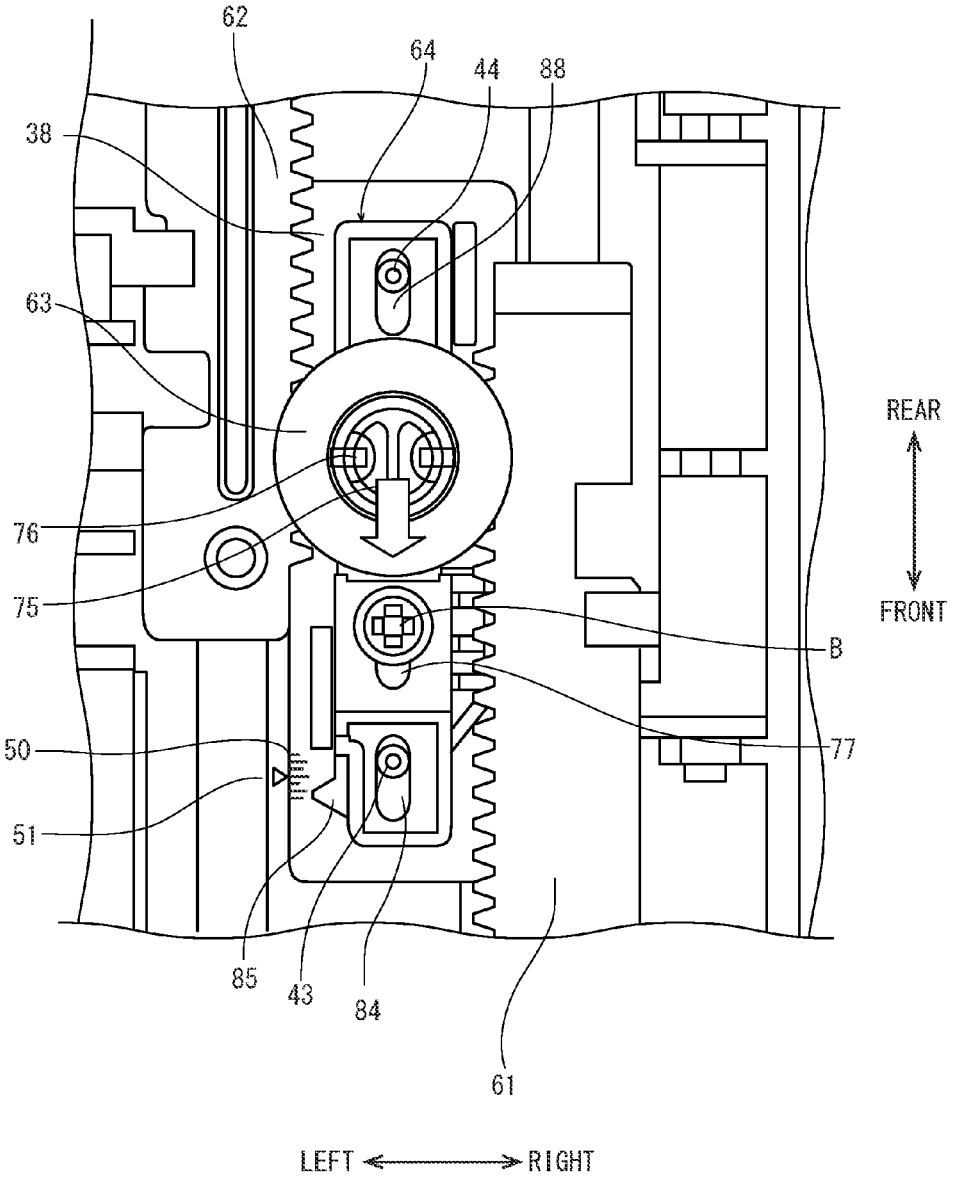
FIG. 8 is a plan view showing a pinion holding member in a state that a pair of cursors are moved forwardly in the sheet feeding cartridge according to the embodiment of the present disclosure.
Figure 9:
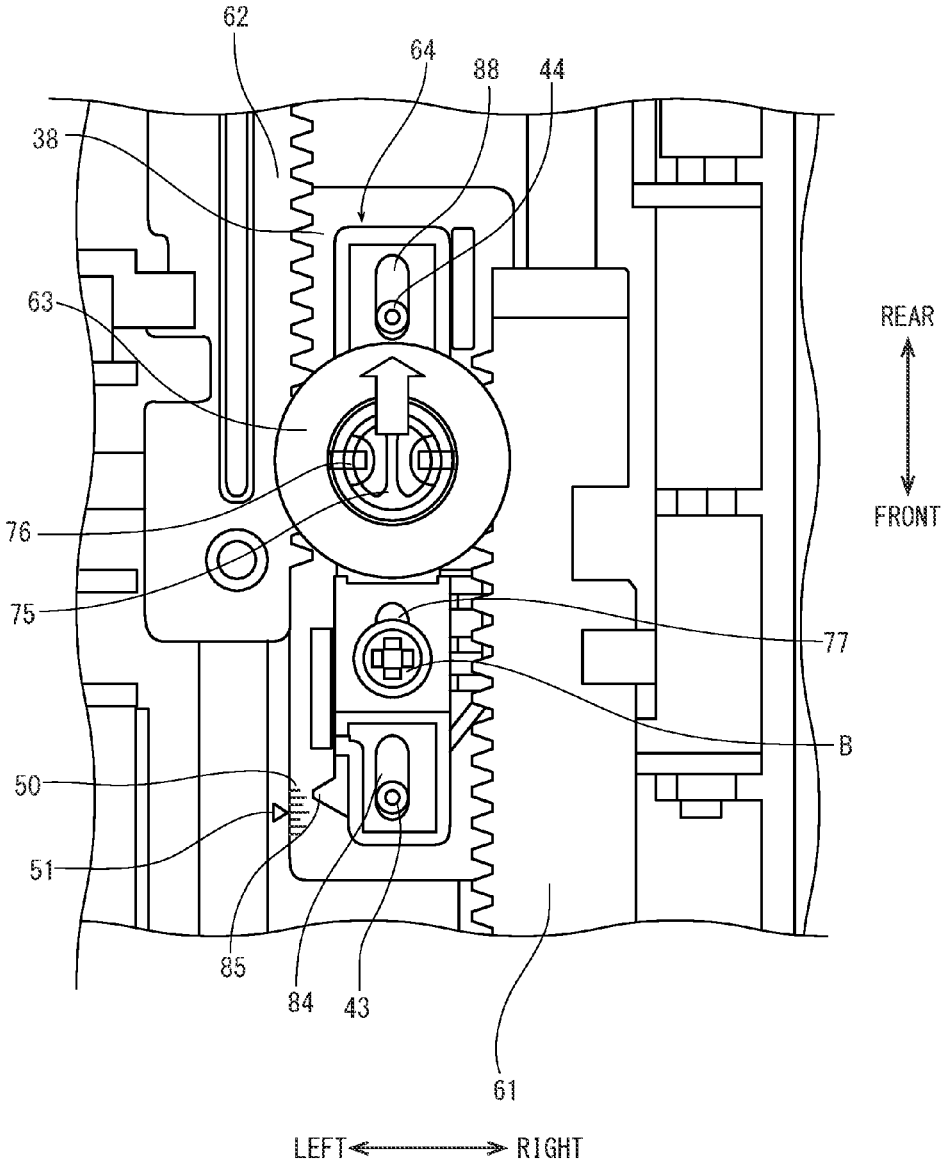
FIG. 9 is a plan view showing the pinion holding member in a state that the pair of cursors are moved backwardly in the sheet feeding cartridge according to the one embodiment of the present disclosure.

Next, center position adjustment for matching the center of the sheet in the forward and backward directions with the center of the image in the forward and backward directions in a case where the center in the forward and backward directions of the sheet stored in the sheet feeding cartridge 3 is displaced from the center in the forward and backward directions of the image formed in the image forming part 5 will be described with reference to FIG. 8 and FIG. 9. This center position adjustment is carried out by a service person, for example, in a case where displacement of the center position is reported. It is to be noted that, in FIG. 8 and FIG. 9, the elevating plate 21 is not shown.

For example, it is assumed that the center of the sheet in the forward and backward directions is displaced backwardly with respect to the center of the image in the forward and backward directions by 3 mm, and it is necessary to displace the center of the sheet in the forward and backward directions forwardly by 3 mm. In this case, the screw B fastening the holding member 64 through the opening 53 of the elevating plate 21 is loosened, and then, the holding member 64 is lifted while grasping the shaft support part 75 to release the engagement of the second rack part 80 with the first rack part 40, and moreover, the holding member 64 is manually moved forwardly. In this time, although the pinion 63 is lifted together with the holding member 64, the engagement of the pinion 63 with the cursor racks 61 and 62 is maintained. Accordingly, the cursor racks 61 and 62 are also moved forwardly together with the holding member 64 along the guiding grooves 37 while keeping a relative position to the pinion 63, and moreover, the front cursor 23 and the rear cursor 24 are also moved forwardly along the guiding depression 36. It is to be noted that the holding member 64 is guided along the front slit 84, the rear slit 88 and the guiding projection parts 45 and 46, and then, the second rack part 80 of the holding member 64 is slid along an upper face of the first rack part 40.

Here, as shown in FIG. 6, since an inclined front side face 81*a* of each of the teeth 81 of the second rack part 80 comes into contact with the inclined rear side face 41*b* of each of the teeth 41 of the first rack part 40, if the holding member 64 is slid forwardly while grasping the shaft support part 75, the second rack part 80 is moved forwardly so that the front side face 81*a* of each of the teeth 81 runs on along the rear side face 41*b* of each of the teeth 41 of the first rack part 40. As shown in FIG. 8, when the holding member 64 is moved forwardly until the point protrusion 85 points out the scale 50 positioned forwardly by 3 mm from the mark 51 as the reference position, the second rack part 80 is engaged with the first rack part 40 and the holding member 64 is fastened to the depression 38 by the screw B. Thereby, the center position between the front cursor 23 and the rear cursor 24 is moved forwardly by 3 mm, and therefore, it is possible to match the center of the sheet in the width direction with the center of the image in the width direction.

On the other hand, in a case where the center of the sheet in the forward and backward direction is displaced forwardly by 3 mm with respect to the center of the image in the forward and backward directions, and it is necessary to displace the center of the sheet in the forward and backward directions backwardly by 3 mm, the screw B is loosened, and then, the holding member 64 is lifted from the depression 38 until the engagement of the second rack part 80 with the first rack part 40 is completely released, and moreover, the holding member 64 is moved backwardly. That is, in order to release the engagement of the second rack part 80 with the first rack part 40, it is necessary that the perpendicular rear side face 81*b* of each of the teeth 81 of the second rack part is moved in a perpendicular direction along the perpendicular front side face 41*a* of each of the teeth 41 of the first rack part 40. In other words, the holding member 64 is moved after the holding member 64 is lifted perpendicularly from the depression 38. When the holding member 64 is moved backwardly until the point protrusion 85 points out the scale 50 positioned backwardly by 3 mm from the mark 51 as the reference position, the holding member 64 is descended to engage the second rack part 80 with the first rack part 40, and the holding member 64 is fastened to the depression 38 by the screw B.

Figure 10:
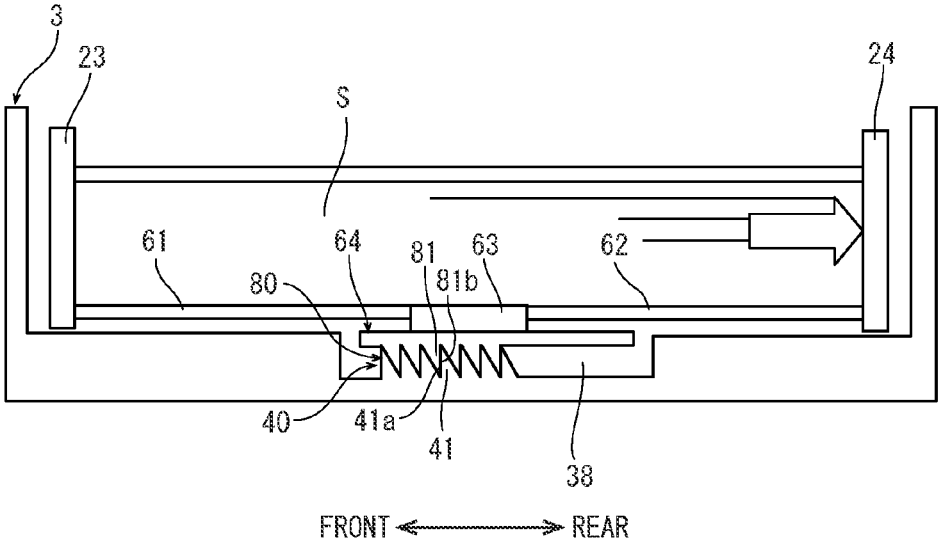
FIG. 10 is a sectional view schematically showing the sheet feeding cartridge when the holding member behaves in accordance with strong insertion of the sheet feeding cartridge according to the embodiment of the present disclosure.

Next, with reference to FIG. 10, a case where the sheet feeding cartridge 3 is inserted into the opening part 2*a* by strong force will be described. When the sheet feeding cartridge 3 is inserted by the strong force, backward force (refer to an outlined arrow in FIG. 10) is applied from the stored sheets S to the rear cursor 24. Accordingly, the backward force is also applied to the holding member 64 via the cursor rack 62 fixed to the rear cursor 24 and the pinion 63 engaging with the cursor rack 62. However, movement of the holding member 64 in the forward and backward directions is restricted by the engagement of each of the teeth 81 of the second rack part 80 with the each of the teeth 41 of the first rack part 40 in the depression 38. Therefore, backward movement of the holding member 64, i.e., backward movement of the front cursor 23 and the rear cursor 24, is restricted. Thus, the first rack part 40 and the second rack part 80 construct a movement restriction part restricting movement in the width direction of the pinion 63 supported by the holding member 64 and the pair of cursor racks 61 and 62 engaging with the pinion 63.

Further, in the present embodiment, a perpendicular rear side face 81*b* of each of the teeth 81 of the second rack part 80 comes into contact with a perpendicular front side face 41*a* of each of the teeth 41 of the first rack part 40. Therefore, the backward force applied to the holding member 64 is dammed, and then, the engagement of each of the teeth 81 of the second rack part 80 with each of the teeth 41 of the first rack part 40 is not released. Therefore, the backward movements of the rear cursor 24 and the front cursor 23 are more strongly restricted.

As described above, according to the present disclosure, the holding member 64 is configured to be attachable to and detachable from the bottom plate 20*a* of the main body part 20, and then, to be supported with respect to the bottom plate 20*a* and allowed to move in the width direction of the sheet in a state that the engagement of the pinion 63 with the pair of cursor racks 61 and 62 is maintained, and to be fixed with respect to the bottom plate 20*a* in any optional position in the width direction of the sheet. Thereby, when the center position adjustment of the front cursor 23 and the rear cursor 24 in the width direction of the sheet is carried out, the holding member 64 holding the pinion 63 is moved with respect to the main body part 20 of the sheet feeding cartridge 3, and thereby, it is possible to move of the front cursor 23 and the rear cursor 24 together with the cursor racks 61 and 62 engaging with the pinion 63. Therefore, it is possible to easily carry out center position adjustment operation even in a narrow space.

In addition, sizes of the slide mechanism 25 of the front cursor 23 and the rear cursor 24 and the movement mechanism of the holding member 64 can be made smaller and the holding member 64 is stored in the depression 38 formed in the main body part 20. Therefore, it is unnecessary to heighten a height of the sheet feeding cartridge 3, and thereby, it is possible to cope with downsizing and space-saving of the sheet feeding cartridge 3.

In addition, on the main body part 20, a scale 50 denoting the reference position of the sheet holding member 64 in the width direction of the sheet and a moved amount from the reference position is formed, and moreover, in the holding member 64, the point protrusion 85 (the point part) pointing out the scale 50 is formed. Therefore, it is possible to easily position the holding member 64 to the reference position and to easily comprehend the moved amount.

Further, once the center position adjustment is carried out by using the holding member 64, the holding member 64 is fixed to the main body part 20 (the bottom plate 20*a*) by the engagement of the second rack part 80 with the first rack part 40, and thereby, it is possible to make engagement force between the holding member 64 and the main body part 20 stronger. According to this, the holding member 64 is hard to move and displacement of the center position is hard to occur. Therefore, positional displacement between the pinion 63 and the pair of cursor racks 61 and 62, i.e., positional displacement between the front cursor 23 and the rear cursor 24, is hard to occur. Further, even when backward force is applied from the sheet to the rear cursor 24 in a case where the sheet feeding cartridge 3 is inserted by strong force and other cases, since the engagement of the holding member 64 with the main body part 20 is difficult to be released, it is possible to prevent displacement of the center position due to movement of the rear cursor 24.

In addition, each of the teeth 41 provided in the first rack part 40 is formed so that the front side face 41*a* (an upstream side face) is perpendicular to the bottom plate 20*a* and the rear side face 41*b* (a downstream side face) is inclined to the bottom plate 20*a* in an installation direction (a direction parallel to the width direction of the sheet) into the housing 2 (the apparatus main body). In addition, each of the teeth 81 provided in the second rack part 80 is formed so that the front side face 81*a* (an upstream side face) is inclined to the bottom plate 20*a* and the rear side face 81*b* (a downstream side surface) is perpendicular to the bottom plate 20*a* in the installation direction (the direction parallel to the width direction of the sheet) into the housing 2 (the apparatus main body). Thereby, it is possible to surely prevent the movement of the holding member 64 in the installation direction. Accordingly, it is possible to prevent positional displacement of the front cursor 23 and the rear cursor 24 due to force applied from the sheet to the front cursor 23 and the rear cursor 24 when the sheet feeding cartridge 3 is installed into the housing 2 by strong force.

In addition, in the present embodiment, the sheet feeding cartridge 3 as the sheet feeding unit has been described. Meanwhile, the present disclosure may be applied to another sheet feeding unit, such as a manual feeding tray, a document conveying device or the like, including a mechanism for sliding a pair of cursors by a rack and pinion mechanism.

Further, the embodiment of the present disclosure was described in a case of applying the configuration of the disclosure to the printer 1. On the other hand, in another embodiment, the configuration of the disclosure may be applied to another image forming apparatus, such as a copying machine, a facsimile, a multifunction peripheral or the like, except for the printer 1.

Further, the above-description of the embodiments was described about one example of the image forming apparatus including this according to the present disclosure. However, the technical scope of the present disclosure is not limited to the embodiments. Components in the embodiment described above can be appropriately exchanged with existing components, and various variations including combinations with other existing components are possible. The description of the embodiment described above does not limit the content of the disclosure described in the claims.

What is claimed is:

1. A sheet feeding unit, that is attachable to and detachable from an apparatus main body, comprising:

a main body part having a bottom plate and configured to be arranged on which a sheet is placed;

a pair of side cursors supported by the bottom plate so as to slide in a width direction of the sheet to restrict a position of the sheet in the width direction;

a pair of cursor racks respectively extending from the pair of side cursors in directions opposing to each other in the width direction of the sheet;

a pinion engaged with the pair of cursor racks; and a holding member having a shaft support part rotatable supporting the pinion, wherein the bottom plate includes a pair of guiding protrusions arranged at a predetermined interval in the width direction, the holding member includes a pair of slits elongated in the width direction and provided at both sides in the width direction, the holding member is attachable to and detachable from the bottom plate, and configured to be supported so as to move in the width direction of the sheet with respect to the bottom plate by respectively inserting the pair of guiding protrusions into the pair of slits in a state that the engagement of the pinion with the pair of cursor racks is maintained, and to be fixed to the bottom plate in any optional position in the width direction of the sheet, on the bottom plate, a scale denoting a reference position of the holding member in the width direction and a moved amount from the reference position is formed and, in the holding member, a point part pointing out the scale is formed.

2. An image forming apparatus comprising a sheet feeding unit according to claim 1.

3. A sheet feeding unit, that is attachable to and detachable from an apparatus main body, comprising:

a main body part having a bottom plate and configured to be arranged on which a sheet is placed;

a pair of side cursors supported by the bottom plate so as to slide in a width direction of the sheet to restrict a position of the sheet in the width direction;

a pair of cursor racks respectively extending from the pair of side cursors in directions opposing to each other in the width direction of the sheet;

a pinion engaged with the pair of cursor racks; and a holding member having a shaft support part rotatable supporting the pinion, wherein the holding member is attachable to and detachable from the bottom plate, and configured to be supported so as to move in the width direction of the sheet with respect to the bottom plate in a state that the engagement of the pinion with the pair of cursor racks is maintained, and to be fixed to the bottom plate in any optional position in the width direction of the sheet, on an upper face of the bottom plate, a first rack part in which teeth extending in an orthogonal direction to the width direction are provided along the width direction is formed and, on a lower face of the holding member, a second rack part in which teeth meshing with the respective teeth of the first rack part are provided is formed, the first rack part and the second rack part are configured to construct a movement restriction part restricting movement in the width direction of the pinion supported by the holding member and the pair of cursor racks engaging with the pinion.

4. The sheet feeding unit according to claim 3, wherein an installation direction to the apparatus main body is a parallel direction to the width direction of the sheet, each of the teeth provided in the first rack part is formed so that an upstream side face in the installation direction is perpendicular to the bottom plate and a downstream side face is inclined to the bottom plate, and each of the teeth provided in the second rack part is formed so that an upstream side face in the installation direction is inclined to the bottom plate and a downstream side face is perpendicular to the bottom plate.

5. An image forming apparatus comprising a sheet feeding unit according to claim 4.

6. An image forming apparatus comprising a sheet feeding unit according to claim 3.

7. A sheet feeding unit, that is attachable to and detachable from an apparatus main body, comprising:

a main body part having a bottom plate and configured to be arranged on which a sheet is placed;

a pair of side cursors supported by the bottom plate so as to slide in a width direction of the sheet to restrict a position of the sheet in the width direction;

a pair of cursor racks respectively extending from the pair of side cursors in directions opposing to each other in the width direction of the sheet;

a pinion engaged with the pair of cursor racks; and a holding member having a shaft support part rotatably supporting the pinion, wherein the holding member is attachable to and detachable from the bottom plate, and configured to be supported so as to move in the width direction of the sheet with respect to the bottom plate in a state that the engagement of the pinion with the pair of cursor racks is maintained, and to be fixed to the bottom plate in any optional position in the width direction of the sheet, the bottom plate includes:

a boss in which a screw hole is formed; and guiding protrusions arranged at both sides of the boss in the width direction, the holding member includes:

an long hole elongated in the width direction; and slits elongated in the width direction and provided at both sides of the long hole in the width direction, the holding member is slidably supported in the width direction by inserting the guiding protrusions into the slits, and fixed to the main body part by fastening a screw inserted through the long hole onto the boss in a state being slid to an optional position and being positioned.

8. An image forming apparatus comprising a sheet feeding unit according to claim 7.

* * * * *